United States Patent [19]

Rigden

[11] 4,004,173

[45] Jan. 18, 1977

[54] NIOBIUM ALUMINA SEALING AND PRODUCT PRODUCED THEREBY

[76] Inventor: Sydney Alfred Richard Rigden, 28, Wayside Avenue, Bushey Heath, Hertfordshire, England

[22] Filed: Dec. 27, 1965

[21] Appl. No.: 516,345

[52] U.S. Cl. ..... 313/317; 65/59 R; 65/155; 65/374 R; 228/122; 220/2.1 R; 220/2.3 R; 313/219; 313/220

[51] Int. Cl. ..... H01j 5/04

[58] Field of Search ..... 65/59, 155, 374; 29/473.1; 313/317, 317 X, 218, 219, 220; 220/2.1, 2.3

[56] References Cited

UNITED STATES PATENTS

| | | | |
|---|---|---|---|
| 2,996,401 | 8/1961 | Welch et al. | 29/473.1 |
| 3,324,543 | 6/1967 | McVey et al. | 65/59 |
| 3,376,121 | 4/1968 | Lawrence | 29/473.1 |

*Primary Examiner*—S. Leon Bashore
*Assistant Examiner*—E. R. Freedman

[57] ABSTRACT

A closure member of refractory metal comprising essentially niobium is sealed over an aperture in an envelope of high alumina content refractory oxide material by means of an interposed sealing layer composed of at least one of the metals titanium, zirconium, vanadium, hafnium, the assembly of closure member, sealing layer and envelope being pressed together and simultaneously heated so that the closure member is alloyed with the sealing layer and hermetically bonded to the envelope. The method is especially applicable to the manufacture of a sodium vapor electric discharge lamp having a tubular envelope of sintered polycrystalline alumina with niobium end caps.

6 Claims, 1 Drawing Figure

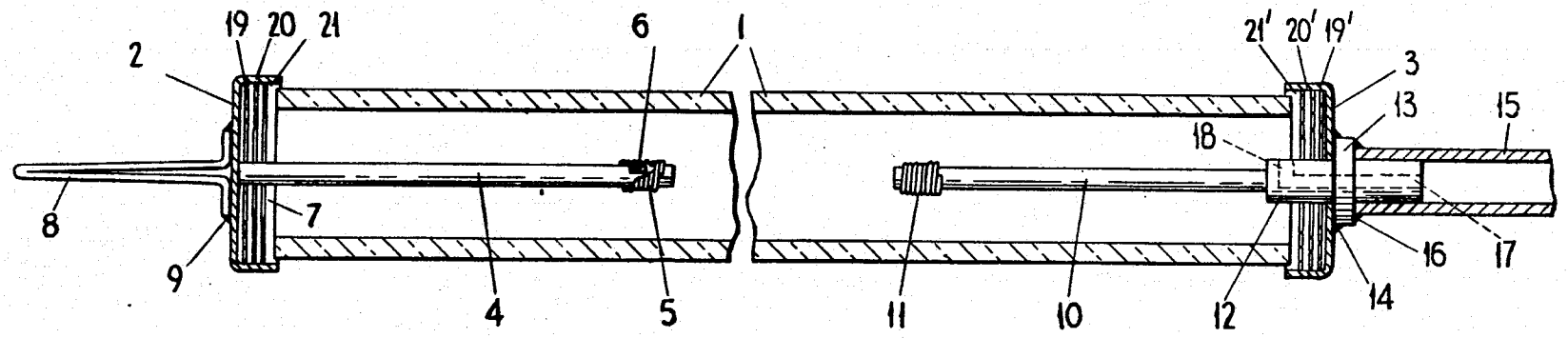
15
17
16
14
3
13
19'
20'
21'
12
18
10
11
1
6
5
4
21
20
19
7
2
9
8

NIOBIUM ALUMINA SEALING AND PRODUCT PRODUCED THEREBY

This invention relates to devices of the kind comprising an envelope of high alumina content material, that is to say a refractory oxide material having an alumina content exceeding 85% by weight, and more particularly relates to the formation of closures for apertures of such envelopes in the manufacture of devices of this kind.

It has, for example, been proposed to form the envelopes of alkali metal vapour electric discharge lamps, particularly sodium vapour electric discharge lamps, from tubes of light-transmissive high alumina content ceramic material, since this material is highly resistant to attack by hot alkali metal vapour. Such envelope tubes may be formed, for example, by compressing very finely divided alumina, possibly with the addition of small amounts of other refractory oxides, for example up to 1% of magnesia, and sintering the compacted powder. It is one object of the present invention to provide a method of forming an end closure for tubes of this kind, which end closure is also highly resistant to alkali metal vapour attack.

According to the invention, in the manufacture of a device comprising an envelope formed of high alumina content material as hereinbefore defined, the method of closing an aperture in the said envelope includes the steps of pressing against the surface of the envelope around the aperture a closure member composed of niobium or a refractory alloy thereof, with a sealing layer consisting of one or more of the metals titanium, zirconium, vanadium, hafnium, interposed between said envelope surface and closure member and heating the assembly in an inert atmosphere (which term includes the use of a vacuum) to a temperature sufficiently high to cause metal from the sealing layer to alloy with the metal of the closure member and produce hermetic bonding of said member to the envelope around the aperture.

By a refractory alloy of niobium, as referred to above, is meant an alloy of niobium with one or more other refractory metals, such that the coefficient of thermal expansion of the alloy is not greatly different from that of niobium itself, for example an alloy of niobium with one or more of the metals selected from the group tantalum, tungsten, rhenium, molybdenum, titanium, zirconium, vanadium, hafnium. Seals formed in accordance with the invention are particularly suitable for use in devices designed to operate at high temperatures, for example electric lamps having envelopes of light-transmissive alumina; the use of niobium for the closure member is particularly advantageous for such a purpose since niobium has a coefficient of thermal expansion closely matching that of alumina, and seals having a closure member of niobium are therefore particularly resistant to temperature cycling.

The closure member must of course have a coefficient of thermal expansion which is suitably close to that of the envelope material, although backing rings of the same material as the envelope and of substantially the same diameter as the aperture in the envelope may be sealed to the opposite side of the closure member, coaxial with the aperture, to reduce strains in the seal if the coefficient of expansion of the closure member differs slightly from that of the envelope material.

Since closure members formed of niobium or a refractory alloy as above defined are highly resistant to alkali metal vapour attack, the method of the invention is particularly suitable for closing the ends of light-transmissive alumina tubes designed to form the discharge envelopes of alkali metal vapour electric discharge lamps.

The closure member may conveniently be in the form of a disc, and may itself extend across and close the aperture of the envelope when it is sealed thereto. Alternatively, in the case of a tubular envelope, the closure member for an open end of the tube may be in the form of a cap fitting over said end and sealed thereto in accordance with the invention. In any case the closure member may be apertured and may carry a further member, for example an electrode support member, which closes the aperture in the closure member, the said further member being sealed to the closure member either before or after the sealing of the closure member to the envelope. In the case of an electric discharge lamp having a tubular envelope of high alumina content material, preferably both ends of the envelope are closed by the method of the invention, and an electrode disposed along the axis of the tube is supported by each of the end closure members.

The method of the invention is especially suitable for closing an aperture in an envelope formed of sintered polycrystalline alumina, with or without minor additions of other refractory oxides such as magnesia. However, the envelope may be composed of other forms of alumina, for example it may be formed substantially of a single crystal of alumina, or it may consist of crystalline alumina deposited from the vapour phase.

The sealing layer may be formed by a thin washer of one of the metals titanium, zirconium, vanadium, or hafnium, which is inserted between the envelope and the closure member so as to surround the aperture in the envelope, the assembly then being pressed together and heated to an appropriate temperature. However, the metals which can be used for the sealing layer all have very high melting points, so that it may be necessary to employ an inconveniently high temperature to effect sealing, with a single metal: for example, when using a titanium sealing layer, the assembly must be heated to a temperature of 1800° to 1850° C. It is therefore preferable to use a suitable alloy of two or more of these metals, that is to say an alloy which is capable of bonding satisfactorily to the material of the envelope, since sealing can be effected at lower temperatures with the alloys than with the single metals. A single thin washer composed of a suitable alloy can be used, or preferably such an alloy is formed in situ, by placing two or more thin washers, each formed of different metals from the group referred to above, between the envelope and the closure member, and pressing and heating the assembly to a sufficiently high temperature to cause the washers to form an alloy, alloying of the metals and formation of the seal thus being achieved in a single operation. The heating step is preferably carried out in argon or in vacuum.

In order to enable satisfactory sealing to be achieved at a conveniently low temperature, the composition of the sealing layer is preferably such as to form an alloy capable of melting at a temperature not higher than 1500° C. For this reason the sealing layer preferably includes zirconium and vanadium, advantageously with titanium in addition to assist in promoting reaction with the surface layers of the alumina of the envelope. Thus in a preferred method of carrying out the invention, three washers respectively consisting of titanium, vanadium and zirconium are inserted between the envelope and the closure member, the titanium washer being placed adjacent to the alumina surface and the zirconium washer adjacent to the closure member.

Since niobium from the closure member is taken up into the sealing layer during the heating step, it will be apparent that niobium can, if desired, be initially included as a constituent of the sealing layer. However, the proportion of niobium initially included in the sealing layer should not be so high as to raise the melting point of the resulting alloy to an undesirable extent.

In the case of a tubular envelope, where both ends of the envelope have closure members sealed to them by the method of the invention, the sealing of both said members to the tube can be carried out simultaneously in a single operation if desired.

The invention includes within its scope devices comprising an envelope formed of high alumina content material having a closure member of niobium or a refractory alloy thereof, bonded to the surface of the envelope around at least one aperture in the envelope by means of a bonding medium consisting of an alloy of the closure member metal with one or more of the metals titanium, zirconium, vanadium, hafnium.

One particular form of sodium vapour electric discharge lamp having a tubular discharge envelope of light-transmissive alumina, which is closed at each end by the method of the invention, is shown diagrammatically in the accompanying drawing and will now be described by way of example.

Referring to the drawing, which shows the lamp in part-sectional elevation, the discharge envelope, 1, is in the form of a straight tube approximately 120 millimeters long and having an internal diameter of 7 millimeters with a wall thickness of 0.8 mm, and is formed by compressing finely divided alumina with up to 1% magnesia, in known manner. Niobium ends caps, 2, 3, each 7/1000 inch thick, are sealed over the ends of the tube, 1, by a method in accordance with the invention to be described in detail below: in the drawing the caps are shown in position ready for sealing but not actually sealed to the ends of the alumina tube, in order that the sealing step may be clearly explained with reference to the drawing.

An electrode in the form of a silicated tungsten rod 15 mm. long and 1.2 mm. in diameter, 4, on which is wound a coil of tungsten wire, 5, retaining a quantity of activating material, 6, is brazed to the niobium end cap, 2, by means of titanium, 7, so as to be supported coaxially within the envelope, 1. A niobium tag, 8, is brazed to the exterior of the niobium cap, 2, also with titanium, 9.

The second electrode is supported by the other niobium end cap, 3: this electrode consists of a similar silicated tungsten rod 12 mm. long, 10, overwound with a coil of tungsten wire, 11, and is brazed with titanium to a molybdenum rod, 12, a length of 3 mm. of which lies within the envelope and which extends through an aperture in the centre of the cap, 3, and widens to form a shoulder, 13, which is brazed to the exterior of the cap, 3, with titanium, 14; a tube, 15, of titanium or niobium is fitted over the external end of the molybdenum rod, 12, and brazed thereto as shown at 16 by means of titanium in the case of a niobium tube, or zirconium and vanadium washers in the case of a titanium tube. The molybdenum rod, 12, has a narrow duct, 17, extending through it from the outer end and terminating at the side of the rod within the envelope, at 18: this duct serves as a pumping stem for evacuating the envelope and introducing the filling into it during manufacture of the lamp.

In manufacturing the lamp, the end cap-electrode assemblies are first completed, as described above, including the attachment of the tube 15, the brazing operations all being carried out in vacuum or in an inert gas atmosphere. Three washers are then placed within each of the niobium end caps, as shown in the drawing, the washers 19 and 19' being of zirconium, 20 and 20' of vanadium, and 21 and 21' of titanium: the preferred thicknesses of the washers are: zirconium 0.004 inch, vanadium 0.0015 inch, titanium 0.002 inch; all the washers have internal and external diameters of approximately 6 mm. and 9 mm. respectively. The end cap assemblies, with the washers spot welded thereto, are then supported in position over the ends of the alumina tube 1, as shown, and the whole assembly is heated in vacuum while pressure is applied to the end caps by supporting the assembly vertically and placing a weight of 3.5 Kgms. on the upper end cap, the assembly being raised from room temperature to 1400° ± 50° C in approximately ten minutes and then allowed to cool. During the heating the washers form alloy of titanium, vanadium and zirconium, which when the washers are of the respective thicknesses specified above, has substantially the composition 68% zirconium, 14% vanadium, 18% titanium, by weight. This alloy further alloys with the niobium of the end caps and bonds the end caps firmly to the ends of the alumina tube 1.

A filling of sodium and rare gas, for example argon at a pressure of about 20 millimeters of mercury, is introduced into the envelope through the tube 15 and duct 17, and the tube 15 is then sealed off by pinching and arc welding in argon. The discharge envelope is mounted coaxially within a cylindrical glass outer jacket designed to maintain the envelope at a suitably high operating temperature when the lamp is in use, electric current supply leads being connected to the electrodes by being attached to the niobium tag 8 and the metal tube 15 respectively: the leads and the outer jacket have been omitted from the drawing for simplicity, since they are both of well known form.

The seals formed at the ends of the discharge envelope, in the lamp of the example, are highly resistant to attack by hot sodium vapour in operation of the lamp, and are also unaffected by the temperature cycling experienced in normal use of the lamp.

The lamp described in the above example may be modified in that the ends of the discharge envelope may be closed by niobium discs carrying the electrode assemblies as described, instead of niobium caps. Furthermore the caps or discs may be sealed to the ends of the alumina tube by means of single washers of one of the metals titanium, vanadium, zirconium, hafnium, the temperature employed for the heating step then being somewhat higher, for example 1800° to 1850° C. in the case of titanium washers.

It will also be understood that the lamp filling may include suitable compounds, such as certain metallic iodides, in addition to sodium, or the sodium may be substituted by any other desired metal or mixture of metals suitable for use in discharge lamps, provided that such additive compounds or substituent metals are non-reactive with the materials of the tube, end caps, and sealing washers.

I claim:

1. A sodium vapor electric discharge lamp having a discharge envelope consisting of a tube formed of light-transmissive sintered polycrystalline alumina, which tube is closed at each end by a niobium closure member carrying an electrode, said closure member being fitted over the open end of the tube and hermetically bonded to the end surface of the tube by alloying of niobium of the closure member with a bonding medium consisting of an alloy of titanium, vanadium and zirconium in the proportions of 68% zirconium, 14% vanadium and 18% titanium by weight.

2. The manufacture of a sodium vapour electric discharge lamp having a tubular envelope formed of light-transmissive sintered polycrystalline alumina and closed at each end by a niobium cap fitted over the open end of the tube, which manufacture includes the steps of inserting between each said cap and the adjacent end of the envelope a sealing layer consisting of zirconium, vanadium and titanium in the proportions of 68% zirconium, 14% vanadium and 18% titanium by weight, then pressing the assembly of envelope, sealing layers and caps together and simultaneously heating the assembly in vacuum to a temperature in the range of 1350° to 1450° C in a period of about ten minutes and then allowing the assembly to cool to room temperature.

3. The manufacture of a device comprising an envelope formed of refractory oxide material having an alumina content exceeding 85% by weight and, closing an aperture in the said envelope, a closure member composed of refractory metal comprising essentially niobium, which manufacture includes the steps of inserting between said closure member and the surface of the envelope around the aperture a metal sealing layer consisting of titanium and zirconium and vanadium, pressing the assembly of closure member, sealing layer and envelope together, and simultaneously with the pressing heating the assembly in an inert atmosphere so as to attain a temperature in the range of 1350° to 1450° C in a period of about ten minutes and then allowing the assembly to cool to room temperature, whereby metal of the sealing layer is alloyed with niobium of the closure member and an hermetic bonding of the said member to the envelope around the aperture is produced.

4. The manufacture according to claim 3, which further includes the step of inserting three washers respectively consisting of titanium, vanadium and zirconium between a said closure member composed of niobium only and the said surface of an envelope composed essentially of sintered polycrystalline alumina, the titanium washer being placed adjacent to the envelope surface and the zirconium washer being placed adjacent to the closure member.

5. The manufacture of a device comprising an envelope formed of refractory oxide material having an alumina content exceeding 85% by weight and, closing an aperture in the said envelope, a closure member composed of refractory metal comprising essentially niobium, which manufacture includes the steps of inserting between said closure member and the surface of the envelope around the aperture a metal sealing layer consisting of titanium and zirconium and vanadium and niobium, pressing the assembly of closure member, sealing layer and envelope together, and simultaneously with the pressing heating the assembly in an inert atmosphere so as to attain a temperature in the range of 1350° to 1450° C in a period of about ten minutes and then allowing the assembly to cool to room temperature, whereby an hermetic bonding of the said member to the envelope around the aperture is produced, the niobium being present in an amount small enough to avoid raising the melting point of the metal sealing layer to an undesirable extent.

6. The manufacture of a sodium vapor electric discharge lamp having a tubular discharge envelope formed of light-transmissive sintered polycrystalline alumina and closed at each end by a niobium cap fitted over the open end of the tube, which manufacture includes the steps of inserting between each said cap and the adjacent end of the envelope three thin titanium respectively consisting of zirconium, vanadium and titanium, the zirconium washer being placed adjacent to the niobium cap and the tatanium washer being placed adjacent to the alumina surface of the envelope, then pressing the assembly of envelope, washers and caps together and simultaneously heating the assembly in vacuum to a temperature in the range of 1350° to 1450° C in a period of about ten minutes and then allowing the assembly to cool to room temperature.

* * * * *

UNITED STATES PATENT OFFICE

CERTIFICATE OF CORRECTION

Patent No. 4,004,173 Dated January 18, 1977

Inventor(s) Sydney A. R. Rigden

It is certified that error appears in the above-identified patent and that said Letters Patent are hereby corrected as shown below:

On the Cover Sheet, Item [73] should read:

--- The General Electric Company Limited, London England ---.

Signed and Sealed this

Twenty-first Day of June 1977

[SEAL]

*Attest:*

RUTH C. MASON
*Attesting Officer*

C. MARSHALL DANN
*Commissioner of Patents and Trademarks*